US006240707B1

(12) United States Patent
Ford et al.

(10) Patent No.: US 6,240,707 B1
(45) Date of Patent: Jun. 5, 2001

(54) CARTON OPENING APPARATUS

(75) Inventors: Colin Ford, Woodstock; Jeff Disrud, Marietta, both of GA (US)

(73) Assignee: Riverwood International Corporation, Atlanta, GA (US)

( * ) Notice: Subject to any disclaimer, the term of this patent is extended or adjusted under 35 U.S.C. 154(b) by 0 days.

(21) Appl. No.: 09/392,173

(22) Filed: Sep. 8, 1999

Related U.S. Application Data

(63) Continuation-in-part of application No. 09/129,350, filed on Aug. 5, 1998, now Pat. No. 6,050,063.

(51) Int. Cl.[7] ..... B65B 43/30; B31B 1/80
(52) U.S. Cl. ..... 53/381.1; 493/315
(58) Field of Search ..... 53/381.1, 458, 53/564, 566; 493/313, 315, 316–319

(56) References Cited

U.S. PATENT DOCUMENTS

| | | | | |
|---|---|---|---|---|
| 2,780,148 | * | 2/1957 | Pearson et al. | 493/313 |
| 3,293,998 | * | 12/1966 | Farnow | 493/316 |
| 3,613,526 | * | 10/1971 | Jones | 493/313 |
| 3,783,752 | * | 1/1974 | Langen et al. | 493/315 |
| 4,064,675 | * | 12/1977 | Stapp et al. | 53/381.1 |
| 4,170,929 | * | 10/1979 | McDowell | 493/313 |
| 4,211,153 | * | 7/1980 | Walters et al. | 493/313 |
| 4,537,587 | * | 8/1985 | Langen | 493/318 |
| 4,596,544 | * | 6/1986 | Hull | 493/313 |
| 4,802,324 | | 2/1989 | Everson . | |
| 4,871,348 | * | 10/1989 | Konaka | 493/315 |
| 5,061,231 | * | 10/1991 | Dietrich et al. | 493/315 |
| 5,155,968 | * | 10/1992 | Mosse et al. | 53/564 |
| 5,411,464 | * | 5/1995 | Calvert et al. | 493/315 |
| 5,561,968 | * | 10/1996 | Palmer | 53/458 |
| 6,050,063 | * | 4/2000 | Ford et al. | 53/458 |

FOREIGN PATENT DOCUMENTS

| | | | |
|---|---|---|---|
| 0734952-A1 | * | 10/1996 | (EP) . |
| 3-85224 | * | 4/1991 | (JP) . |
| 4-115934 | * | 4/1992 | (JP) . |
| WO-97/25246 | * | 7/1997 | (WO) . |

* cited by examiner

*Primary Examiner*—Stephen F. Gerrity
(74) *Attorney, Agent, or Firm*—Womble Carlyle Sandridge & Rice, PLLC

(57) ABSTRACT

A carton opening assembly for a continuous motion packaging machine directs opposed carton engaging plates perpendicular to opposite side walls of a collapsed carton moving through the opening assembly. A vacuum is applied to the opposed carton side walls when the assemblies engage the carton. One or both of the opposed carton engaging assemblies are retracted to filly open the carton, which is then transferred to a conveyor that transports the carton to the next workstation of the packaging machine. The carton opening operation is accomplished while tracking the carton movement through the carton opening assembly.

12 Claims, 8 Drawing Sheets

CARTON OPENING APPARATUS

CROSS REFERENCE TO RELATED APPLICATION

This application is a continuation-in-part of U.S. patent application Ser. No. 09/129,350, filed Aug. 5, 1998 (now U.S. Pat. No. 6,050,063).

FIELD OF THE INVENTION

This invention generally relates to a carton opening assembly for use in a continuous motion packaging machine for packaging articles such as, for example, beverage containers. More particularly, this invention relates to a method and apparatus for opening collapsed, paperboard, basket-type cartons in continuous fashion, so that the cartons thereafter can be transferred fully opened to a carton transport mechanism for delivery to the next workstation in the continuous motion packaging machine.

BACKGROUND OF THE INVENTION

Continuous motion article packaging machines, such as those used in the beverage packaging industry are well-known, and various types of packaging machines are constructed to accomplish the packaging of articles into different types of cartons. One such machine enables articles, such as glass or plastic bottles, to be packaged in a basket-type carton. These cartons or baskets generally are in one of two forms. One basket has a pre-glued bottom and a locking system which engages when the collapsed carton is fully opened, and then holds the carton open so that the articles can be inserted into the open cells of the basket. For example, Riverwood International Corporation's Rough Rider 2000™ opening machine is used in conjunction with a basket-type drop packing machine designed to process a basket-type carton with a pre-glued base or bottom wall. The second type of basket does not have a pre-glued bottom, but instead is designed to define an opening between the side walls so that the partially assembled carton can be lowered onto a pre-configured bottle group. Once the basket is lowered around the bottle group so that the bottles are individually received within the basket side walls, flaps which initially extend from opposing side walls are folded into contact with one another to form the base of the completely assembled basket containing the articles.

Each basket-type packaging machine, including those comprised of carton opening assemblies combined with ancillary article loading devices, generally includes several similar workstations. In each machine, collapsed, partially assembled baskets are fed onto a transport mechanism by a carton pick and transfer assembly, or carton feeder. The transport mechanism then moves the collapsed cartons in continuous fashion to a carton opening assembly. During the transportation of the collapsed carton from the carton feeder to the carton opening assembly, one or more of the carton flaps, or the carton itself, may be manipulated into a desired position. At the carton opening assembly, the collapsed carton is manipulated into an opened position. At the downstream end of this workstation, the subsequent handling of the opened carton and the article loading operation differs, depending upon the type of basket packaging machine utilized. In all types of these machines, however, the result of the final workstation is a fully assembled, basket-type carton carrying the packaged articles. Such packaging machines can be comprised of a unitary device having all such workstations, or can include a series of assemblies linked together to include each such workstation.

In the Rough Rider 2000™ packaging machine, the collapsed carton is transported from the carton feeder on its side, and delivered to the carton opening assembly. The carton opening assembly comprises two vacuum plate assemblies which engage opposite sides of the carton, and pull the carton into a fully opened position. The carton processed by the Rough Rider 2000™ machine includes a pre-glued bottom wall or base with toe locks which engage the fully opened bottom wall to hold the carton or basket in a fully opened position. The basket processed by the Rough Rider 2000™ machine then is oriented to a handle up position, and is transported to an ancillary article loading machine which places the articles, such as bottles, into the fully opened basket. The vacuum plate assemblies of the Rough Rider 2000™ machine include two pairs of rotating wheels or pivots, each of which moves a vacuum plate in a circular motion at a fixed velocity. The vacuum plate transcribes a walking beam motion in which every point of the vacuum plate transcribes a circle relating to the pivot radius. Ideally, the vacuum cups of the Rough Rider 2000™ opening assembly will strike the carton side wall in a direction as close to vertical, or perpendicular to the side walls as possible, at which point the vacuum is applied by vacuum lines to the vacuum cups engaging the basket side wall. As the vacuum plate continues to be moved in an arc, the upper basket side wall follows that motion and ultimately is placed in a fully opened position as it continues to travel through the opening assembly on the transport conveyor. The same type of apparatus applies the same manipulation to the lower basket side wall.

In this type of opening assembly, however, there exists a speed differential due to the basket's traveling on its side in a horizontal motion or direction along the machine's longitudinal path by the transport conveyor at a fixed velocity, and the vacuum cup's moving in a circular motion, the horizontal component of which constantly changes. It is intended that the conveyed carton and the opening assembly will be at a matching speed at the moment of contact. Even if all conditions are ideal and such speed matching is accomplished, however, the vacuum cups will strike the carton side wall at an angle less than 90° rather than perpendicular, which results in vacuum cup wear. A second factor associated with the Rough Rider 2000™-type opening assembly, which results from the change of speed of the horizontal component of the carton side wall as it moves through the assembly in a progressively opened configuration, is that the carton tends to be opened abruptly, imparting a shock to the carton at its maximum opened position. This abrupt opening, however, is considered suitable for the Rough Rider 2000™-type carton, considering that it includes a relatively stable, pre-glued base. In the Rough Rider 2000™ packaging machine, the maximum opening time achievable, which is a theoretical maximum, is a quarter of a cycle of the rotating pivots from the point the vacuum cups engage the carton to the point where the carton is fully opened. Typically, however, the opening time would be less than a quarter of the cycle in practical applications, as the horizontal velocity component is zero at 90°. Both the above factors limit the machine's maximum speed.

A second type of basket packaging machine processes baskets without a pre-formed base or bottom wall. An example of this type of machine is Riverwood International Corporation's Autoflex 2000™ machine. This type of packaging machine is a basket-type machine in which the fully opened basket is lowered over the pre-configured bottle group at the article packaging workstation. That is, in this system, rather than dropping the product into the pre-formed basket, the product proceeds through the machine in a straight line, and the open-base basket is lowered over the product, with its bottom flaps thereafter glued underneath. The Autoflex 2000™ packaging machine also includes opposed vacuum plates, and walking beam-type opening mechanisms, which results in the same limitations as found with the Rough Rider 2000™ opening assembly. The Autoflex 2000™ packaging machine also includes servo motors to actuate the opening mechanism so that the opening cycle is more efficiently timed with the progression of the collapsed carton through the opening assembly, thus improving the performance over earlier systems.

Known basket opening mechanisms, such as those described above, however, while efficient in many respects and applications, still are limited in some respects due to the characteristics of the vacuum plate motion in the opening cycle. Additionally, some of these known opening mechanisms include a pair of drive chains that carry a series of opposed vacuum plates into engagement with unopened cartons. These chains can, however, stretch or become slack, especially with wear and extended use, causing slipping and misengaging the cartons. The chains further tend to limit the length of the opening cycle, necessitating a rapid or abrupt opening of the cartons.

There is a need in the art, therefore, for a basket-type carton opening mechanism which can accomplish more controlled basket opening over a longer period of time through a longer transport distance, and that also contacts the basket side walls perpendicularly and tracks the carton through the machine as the carton is opened. The invention of the present application presents a novel method and apparatus to overcome many of the disadvantages of prior art basket opening assemblies, and accomplishes these desired results.

SUMMARY OF THE INVENTION

The present invention comprises a carton opening assembly and method for opening partially formed, collapsed paperboard cartons, such as are used in the beverage container packaging industry. While the method and apparatus disclosed and claimed can be used to open paperboard cartons, the present invention is not limited to opening cartons, but also could be utilized to open any article from a collapsed condition having a side wall which can be engaged by opposed contact members, such as vacuum cups. The opening assembly is designed to open cartons in a continuous fashion being fed to the opening assembly by a carton conveyor, such as for packaging machines, including but not limited to those which open a basket for later placement onto a bottle group. The opening assembly comprises a series of carton engaging assemblies adapted to engage the opposed side walls of a collapsed paperboard carton. The engaging assemblies disclosed utilize pairs of opposed vacuum plates each having a series of vacuum cups mounted thereon, although other types of engaging members, including those providing for mechanical engagement, could be utilized.

The carton engaging assemblies are driven in continuous fashion about head and tail sprockets along an engaging path in timed relationship with cartons passing through the opening assembly. A vacuum distribution sprocket or assembly is mounted adjacent the drive assembly for the carton engaging assemblies for supplying a vacuum to the vacuum plates of each carton engaging assembly as the vacuum cups of the vacuum plates engage the carton side walls. The pairs of spaced vacuum plates each are mounted on a slide bar supported on and guided about the engaging path by cam tracks engaged by cam followers mounted to the slide bars. The movement of the cam followers along the cam tracks causes the vacuum plates to be moved toward and away from one another as the carton engaging assemblies are moved along their engaging path.

The opening assembly is designed so that elements of the carton engaging assemblies are moved toward the collapsed carton side walls in a direction perpendicular to the carton side walls and perpendicular to the path of travel of the carton through the opening assembly. This motion of the carton engaging assemblies occurs while the carton engaging assemblies are moving along the path of travel in the direction of carton feed. In this manner, the carton engaging assemblies track the motion of the carton through the opening assembly as the vacuum cups of the vacuum plates of each carton engaging assembly engage and pull one or more of the carton side walls outwardly to either partially or fully open the carton. As a result, each carton engaging assembly will contact a carton and place it in either a fully or partially opened position before the engaging assemblies pass through a return path to repeat the opening method or operation. The opening assembly can be utilized to place the carton either into a partially opened or a fully opened position, depending upon the desired state of opening of the carton at the downstream workstation.

Various objects, features and advantages of the present invention will become obvious to those skilled in the art upon reading the following detailed description when viewed in conjunction with the accompanying drawings.

DETAILED DESCRIPTION OF THE PREFERRED EMBODIMENTS

Figure 1:
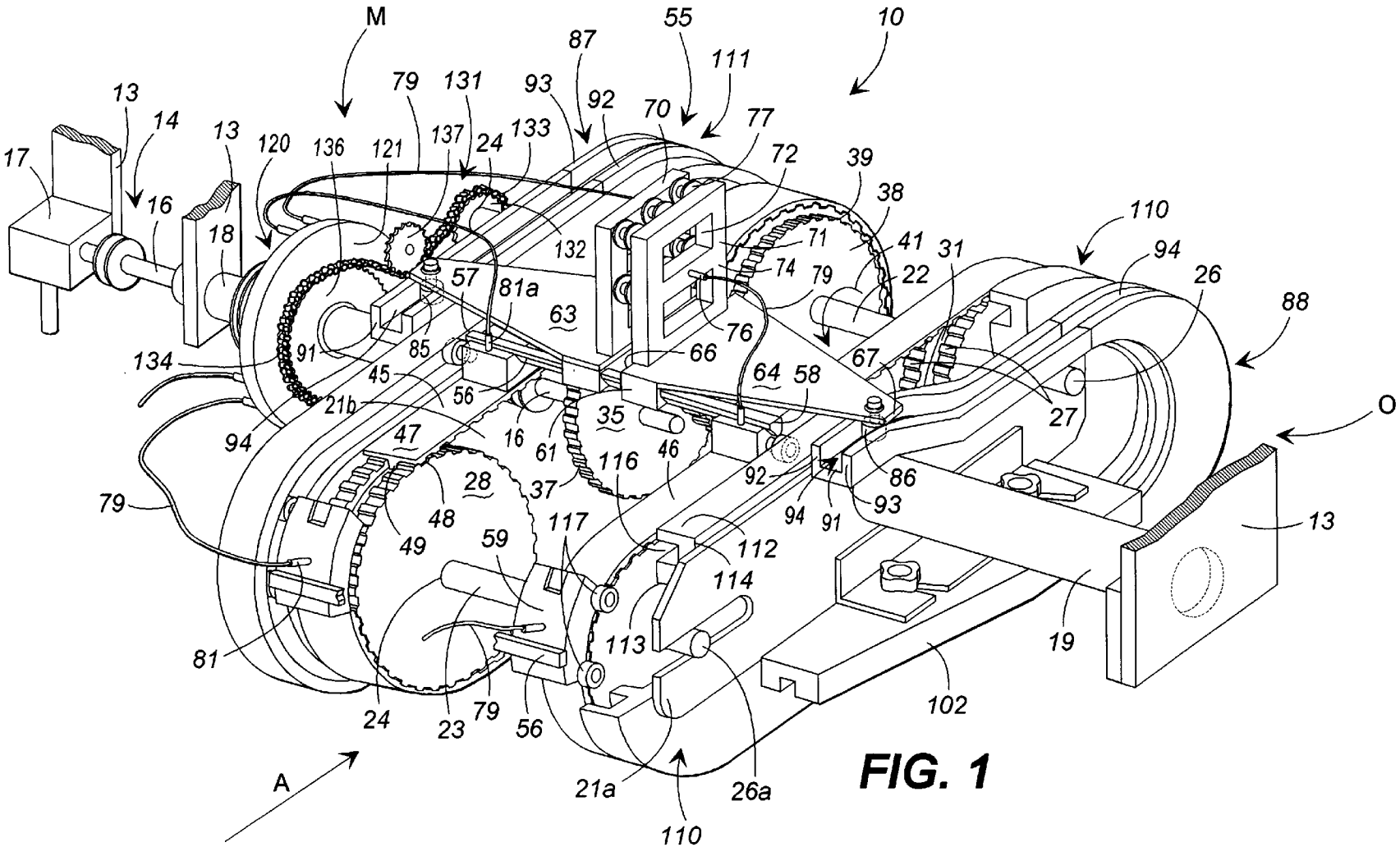
FIG. 1 is a perspective view of one embodiment of the opening assembly of the present invention.

Referring to the drawing figures, in which like reference numerals refer to the same elements, FIG. 1 shows opening assembly 10, which primarily is intended to open partially formed, collapsed basket-type cartons for article carriers. For purposes of description of the present invention, the terms "cartons," "carriers," or "baskets" are used interchangeably to describe a basket-type paperboard carton. This invention, however, including the method and apparatus described and claimed, is not intended to be limited to an opening assembly or apparatus and method for use only in opening paperboard cartons. Instead, the present invention could be utilized to manipulate any suitable object, as described herein.

Figure 2:
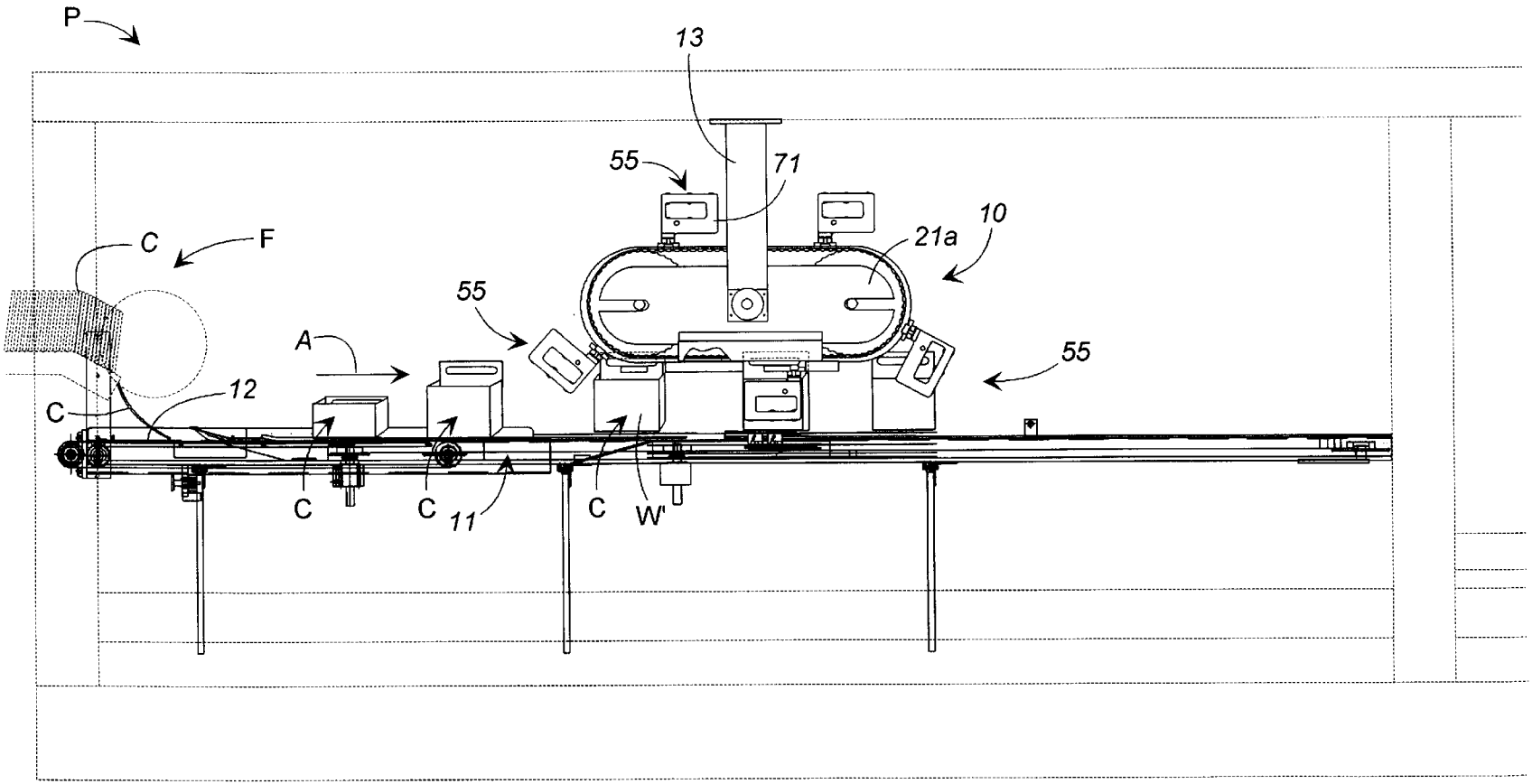
FIG. 2 is a schematic, side elevational view of part of an article packaging machine showing placement of the embodiment of FIG. 1.

FIG. 2 depicts the orientation and placement of opening assembly 10 in a continuous motion article packaging machine P, while illustrating only the first two workstations of packaging machine P. These include carton feeder F, which is the most upstream workstation, and opening assembly 10, which is positioned downstream of feeder F along a conveyor assembly 11. The carton feeder F places cartons onto a lugged belt mechanism 12 (FIGS. 2, 7) which registers the carton in time to the packaging machine P. The conveyor assembly receives a carton C from the lugged belt mechanism 12, and transports the carton C downstream in the direction of arrow A (feed direction) to opening assembly 10. FIG. 2 depicts numerous cartons C, which are collapsed and arrayed in a magazine arrangement in feeder F. The carton feeder F can be any one of numerous, well-known carton feeders capable of delivering a collapsed basket-type carton from a supply magazine to the transport mechanism. Similarly, the transport mechanism can be one of any well-known transport mechanisms such as belt conveyors or chain conveyors having upstanding lugs, such as those conveyors used on prior packaging machines, including the machines discussed above. Some known systems utilize more than one conveying system, such as a conveyor belt, to transport the carton from feeder F to a chain conveyor which moves the carton to the opening assembly.

Figure 3:
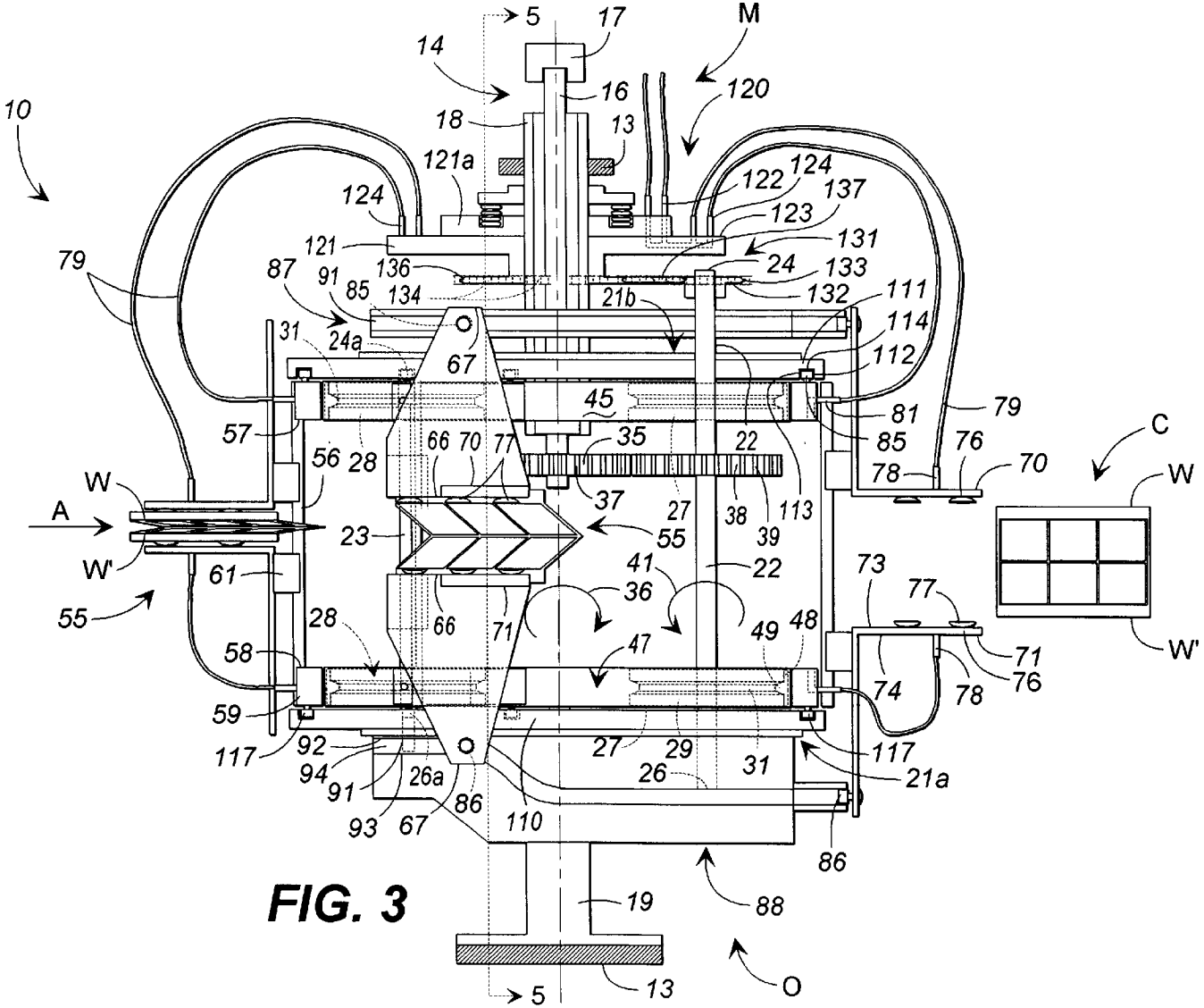
FIG. 3 is a plan view of the embodiment of FIG. 1.
Figure 7:
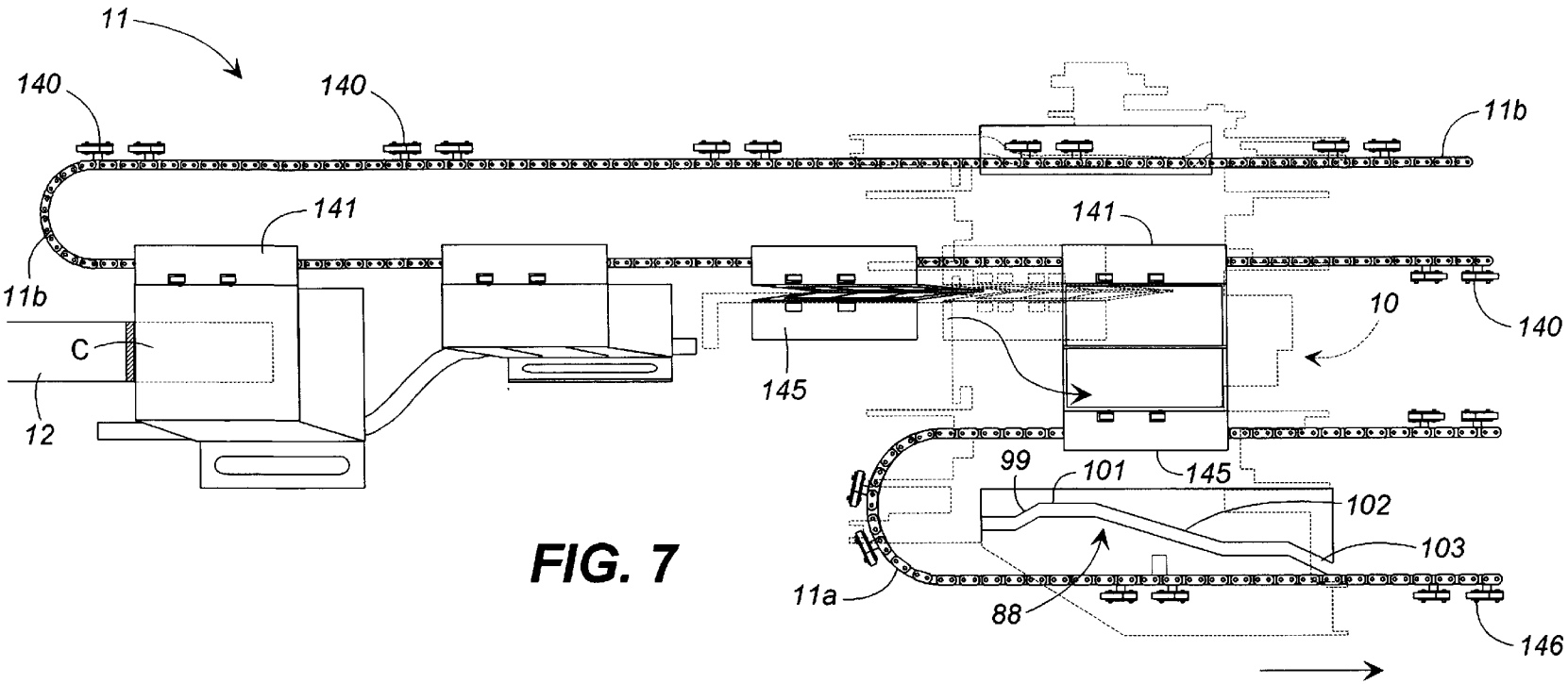
FIG. 7 is a schematic, plan view of the carton transport conveyors of an article packaging machine, showing the embodiment of FIG. 1 in phantom lines.
Figure 8:
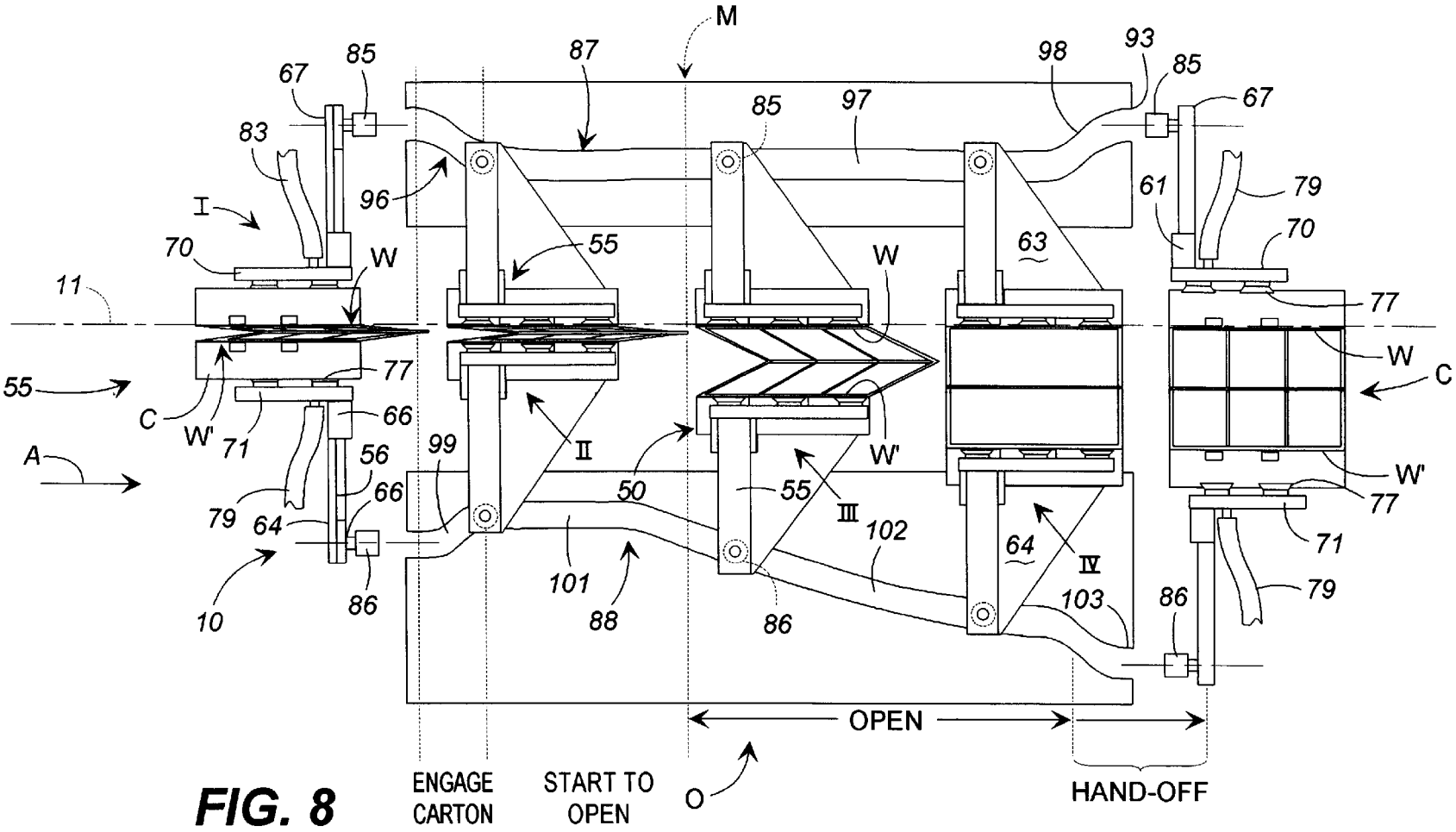
FIG. 8 is a schematic representation of the opening sequence of the embodiment of FIG. 1.

The present invention is not limited to any conveying system or type of conveyor. Various known systems capable of delivering a correctly oriented carton to the opening assembly are acceptable. Such feeders and transport assemblies are well-known and are not further described. The embodiment of the opening assembly 10 illustrating the present invention, however, contemplates that the collapsed carton entering the opening assembly 10 will be oriented with its handle extending vertically upward and its bottom wall flaps, which are attached to opposed side walls, arranged outwardly, such as in a substantially horizontal orientation. The collapsed carton or basket entering the opening assembly 10 generally is oriented in an arrow-shaped configuration, with a leading edge of the carton pointing downstream, as shown in FIGS. 3, 7 and 8. It is also known in the art of carton transport or conveying assemblies to provide carton orienting devices such as camming plates, which properly orient the basket and its bottom wall flaps as it is moved toward the opening assembly. Such orienting devices, being known in the art and part of known article transport assemblies, are not further described. For purposes of illustrating the present invention, however, a chain conveyor assembly 11 is illustrated. A known belt-type system or combination of belt and chain systems also could be used.

Lugged belt mechanism 12 receives a collapsed carton C from feeder F, and transfers the carton C in time to conveyor assembly 11 and moves the carton into contact with cam plates (not shown) which orient the carton with its handle extending vertically and aligned with conveyor 11 front to rear with bottom wall flaps extending outwardly and a leading point or edge facing downstream. Conveyor assembly 11 then moves carton C downstream to opening assembly 10 along a path of travel in the direction of arrow A. As will be further described, the chain conveyor assembly used for illustrating the present invention includes lugs which engage openings in the bottom wall flaps of the carton C to move the carton in the downstream direction along the path of travel depicted by arrow A.

Referring again to FIG. 1, the opening assembly 10 includes a support frame 13, which supports, directly or indirectly, the remaining elements of opening assembly 10. A drive assembly 14 or drive system is positioned on a machine side M of the opening assembly, and operatively engages the opening assembly to drive the driven components of the opening assembly in order to accomplish the component movement and opening methods described. The drive mechanism 14 can include a motor, such as an AC or servomotor, directly driving a main input drive shaft 16. Alternatively, as indicated in FIG. 1, drive mechanism 14 can be a bevel gear box 17 translating the direction of rotation of an input shaft extending from one of the packaging machine's main drive mechanisms (not shown). The drive shaft 16 extends through the support frame on side M extending through sleeve 18 into the center of assembly 10 and through one of a pair of side frame plates 21*a* and 21*b* as shown in FIGS. 1 and 3.

As shown in FIGS. 1 and 3, the drive assembly 14 further includes an elongated head shaft 22 positioned at the downstream end of the opening assembly 10, and a tail shaft 23 positioned at the upstream end of the opening assembly and spaced from and extending substantially parallel to the head shaft 22. The head and tail shafts generally are elongated axles, typically formed from steel or similar material, with head shaft 22 having first end 24 and second end 26 and tail shaft 23 having first end 24*a* and second end 26*a* (FIG. 3). Shafts 22 and 23 extend across the path of travel A of the cartons with the first and second ends rotatably engaging the side frame plates 21*a* and 21*b*. A pair of head sprockets 27 (FIG. 3) are fixed to shaft 22 and mounted adjacent the opposite ends of the head shaft 22, positioned on opposite sides of the path of travel of the cartons. A pair of tail sprockets 28 are mounted to the tail shaft 23, positioned at the upstream end of the side frame plates 21*a* and 21*b* as shown in FIGS. 1 and 3, positioned in alignment with and spaced from the head sprockets 27. Each of the head and tail sprockets 27 and 28 generally is a toothed sprocket or "V-pulley" with an approximately thirty inch circumference, and includes a series of approximately sixty radially projecting teeth 29 on a ½ inch pitch. A channel or notch 31 is milled or cut approximately in the center of each sprocket, and extends about the circumference of each sprocket (FIG. 1). It will also be understood by those skilled in the art that the head and tail sprockets also could be formed from pairs of sprockets mounted side-by-side and spaced slightly apart so as to form the channel or notch 31 therebetween.

Figure 5:
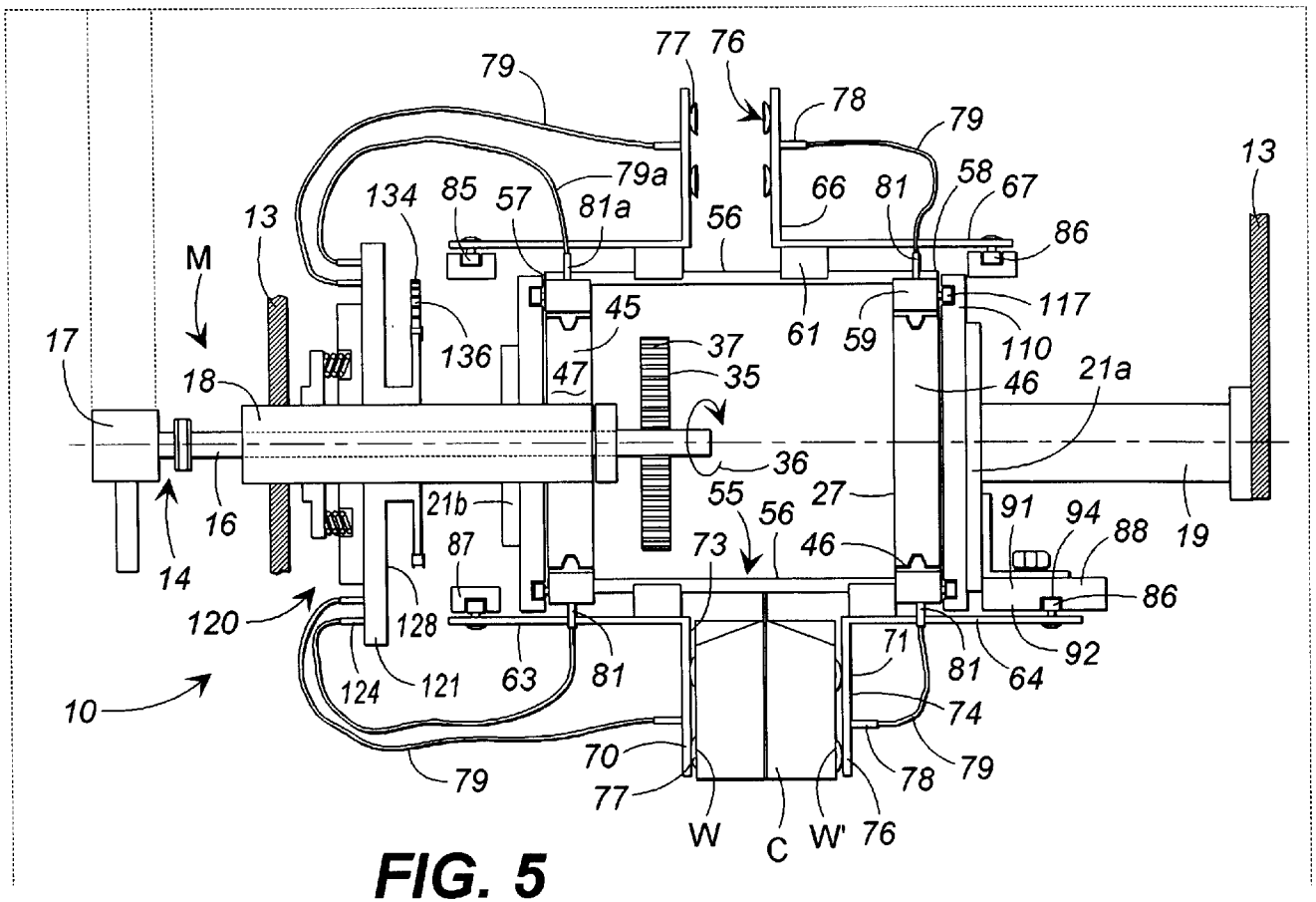
FIG. 5 is a partial, cross-sectional end view of the head shaft and related components of the embodiment of FIG. 1, taken along lines 5—5 of FIG. 3.

As shown in FIGS. 1, 3, and 5, the drive mechanism 14 further includes a main drive gear 35 mounted to the main drive shaft 16, positioned along the inside of the frame side plate 21*b* toward the machine side M of the opening assembly 10. The main drive gear 35 generally is a spur gear that is fixedly mounted to the main drive shaft 16 so as to be rotated with the rotation of the main drive shaft in the direction of arrow 36 (FIG. 3) adjacent the internal end of sleeve 18, and includes a series of radially projecting teeth 37. A secondary driven gear 38 is mounted to the head shaft 22, positioned adjacent and downstream from the main drive gear 35 and in alignment with gear 35 (FIG. 3). The driven gear 38 is a spur gear that is fixedly mounted to the head shaft, and includes a series of radially projecting gear teeth 39 that engage and mesh with the teeth 37 of the main drive gear 35. As a result, as the main drive gear is rotated in the direction of arrow 36, the teeth 37 of the main drive gear engage and mesh with the teeth 39 of idler gear 38 so as to cause the idler gear and thus the head shaft 22 to be rotated in an opposite direction as indicated by arrow 41 (FIG. 3).

Figure 6:
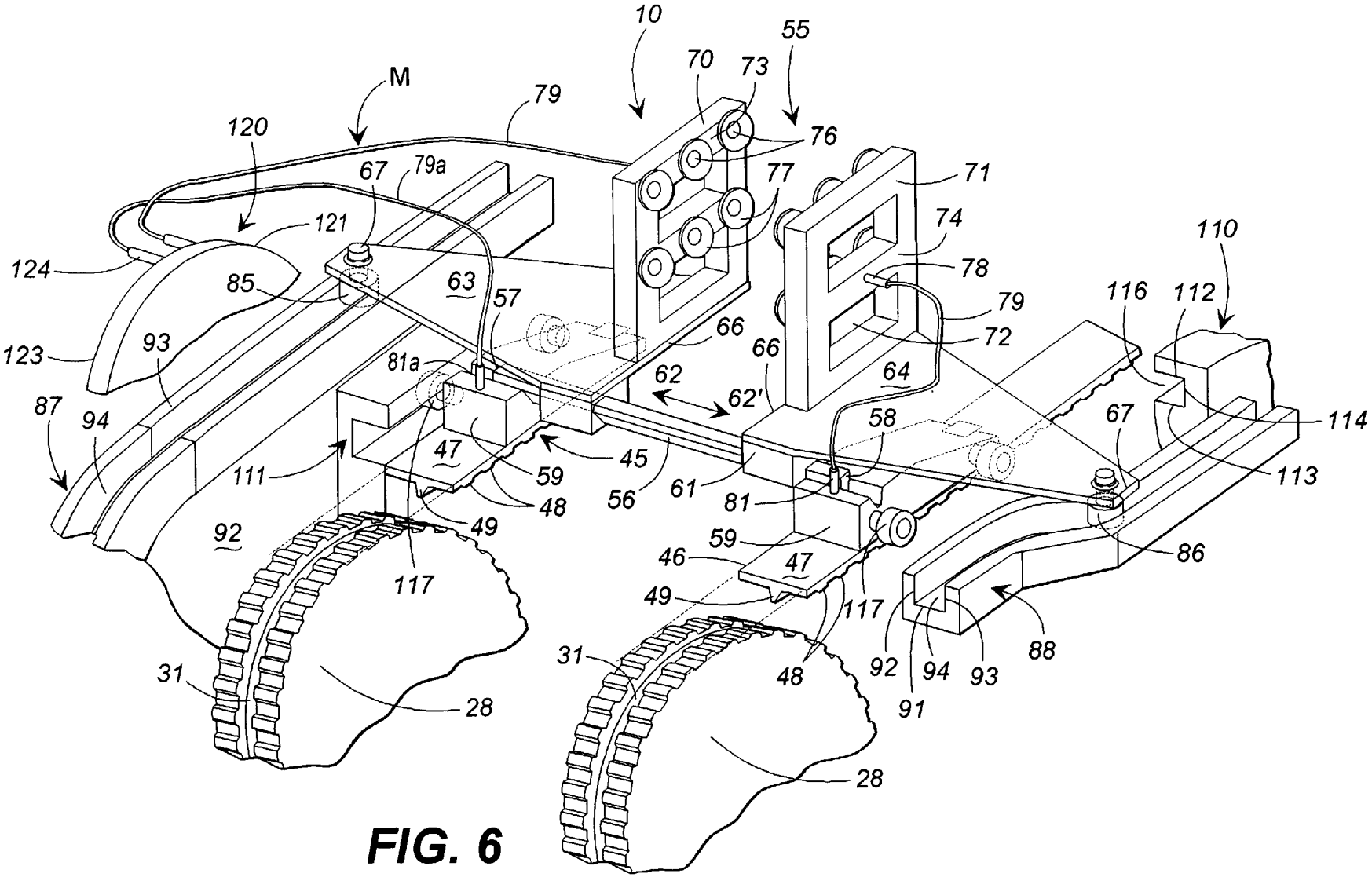
FIG. 6 is a perspective, partial view of one carton engaging assembly of the present invention.

As illustrated in FIGS. 1 and 6, a pair of drive belts 45 and 46 are extended about the head and tail sprockets 27 and 28, respectively (FIG. 3), extending about an elliptical path essentially parallel to the path of travel A and positioned on opposite sides of the side frame plates 21*a* and 21*b*. The belts each are approximately 75 inches in length, and comprise a substantially continuously looped belt formed from a durable plastic material such as polyurethane and reinforced with steel wire or similar reinforcing material. An example of such a continuous length reinforced belts include polyurethane timing belts manufactured by BRECOFLEX Co., LLC, although it will be understood by those skilled in the art that various other types of durable, high strength drive belts also can be used.

Each drive belt 45 and 46 further generally includes a central web portion 47 that extends substantially horizontally, parallel to the path of travel of the belts about the head and tail sprockets. Each belt 45 and 46 also includes a series of teeth or projections 48 (FIG. 6) generally on a ½ inch pitch. The teeth 48 of the belts are adapted to engage the teeth of the head and tail sprockets so as to be rotated about the path of travel with the rotation of the head sprocket in response to the driving of main drive gear 35 (FIG. 3) and driven gear 38 by the drive mechanism 14. Thus, as the drive belts engage and are pulled about the path of travel of the cartons by the rotation of the head sprockets, the engagement of the teeth 48 of the drive belts 45 and 46 with the teeth of the tail sprockets causes the tail sprockets likewise to be rotated in the direction of arrow 41. The drive belts further each include a vertically extending V-shaped projection 49 (FIG. 6) that is received within and passes through the channel 31 formed in each head and tail sprocket as the drive belts are conveyed about the head and tail sprockets, as illustrated in FIGS. 1 and 6. The receipt of projection 49 within channel 31 ensures that the drive belts stay centered on the head and tail sprockets as the belts engage and are moved about their respective elliptical paths with the rotation of the main drive gear and head and tails shafts by the drive mechanism.

As shown in FIGS. 1–4, a series of carton engaging assemblies 55 are carried about the opening assembly 10 by the belts 45 and 46 along a substantially elliptical path in the direction of arrows A and A' (FIG. 4) and into engagement with the cartons C moving along the conveyor 11. Typically, either five carton engaging assemblies each on a 15 inch pitch, or six carton engaging assemblies on a 12½ inch pitch, are mounted on the drive belts to enable elongated opening runs for the carton engaging assemblies. As illustrated in FIGS. 1 and 6, each of the carton engaging assemblies 55 includes a slide bar 56 that extends laterally across the opening assembly 10 perpendicular to the path of travel of the carton engaging assemblies. Each slide bar is an elongated, substantially rectangular-shaped bar that is generally includes a hollow inner chamber (not shown) formed along its length, and further includes first and second ends 57 and 58 (FIG. 6). Carriages 59 are mounted to the first and second ends 57 and 58 of each of the slide bars 56. The carriages are pivotally mounted to the drive belts 45 and 46, as shown in FIG. 6, with clamps that are received in cut away portions of the V-sections of each belt, secured by pins (not shown). The carriages 59 extend rearwardly from the slide bars and support the first and second ends 57 and 58 of the slide bars 56 on the drive belts. The pivotable attachment of the carriages to the drive belts enables the carriages, and thus the slide bars, to move rotationally about the head and tail sprockets of the drive mechanism, with the movement of the drive belts.

Slide blocks 61 are slidably mounted on the slide bars 56 so as to be reciprocally movable along the slide bars in the direction of arrows 62 and 62'. The slide blocks generally are substantially rectangular blocks formed from a plastic such as Delrin®, nylon, linear ball bearing or similar rigid, durable material so as to reduce friction between the slide bar and the slide blocks, Each slide block has a notched profile in which a portion of each slide bar is received (FIG. 6). The slide blocks 61 function as linear slide bearings that slide along a portion of the length of each slide bar. A pair of generally triangular support plates 63 and 64 are mounted to each of the slide blocks 61 so as to be movable therewith. The support plates are formed from metal or from a rigid material such as Delrin®. Each of the support plates 63 and 64 includes a first, inward side 66 along which the support plates are mounted to their respective slide blocks, and a second or outer flange 67 that projects over and extends outwardly of the drive belts 45 and 46.

Vacuum plates 70 and 71 are mounted to each of the support plates 63 along the first side 66 thereof. Each of the vacuum plates 70 and 71 is shown in the present embodiment as being a substantially rectangular plate having openings 72 defined therein, which openings generally are defined in each plate to reduce mass, though it will be understood by those skilled in the art that various other constructions also can be used as long as the associated cups are appropriately positioned to contact the cartons, as described herein. Each of the vacuum plates includes an interior side wall 73, an exterior side wall 74 and an internal vacuum chamber or passage (not shown). A series of vacuum ports 76 are formed through the interior side wall 73 of each vacuum plate, about which vacuum cup 77 or suction cup is attached as illustrated in FIG. 6. For the purposes of illustrating the present invention, FIG. 6 depicts each vacuum plate as having approximately six vacuum cups, although the number of vacuum ports and associated suction or vacuum cups can vary depending on the type and design of carton or basket being opened.

Figure 4:
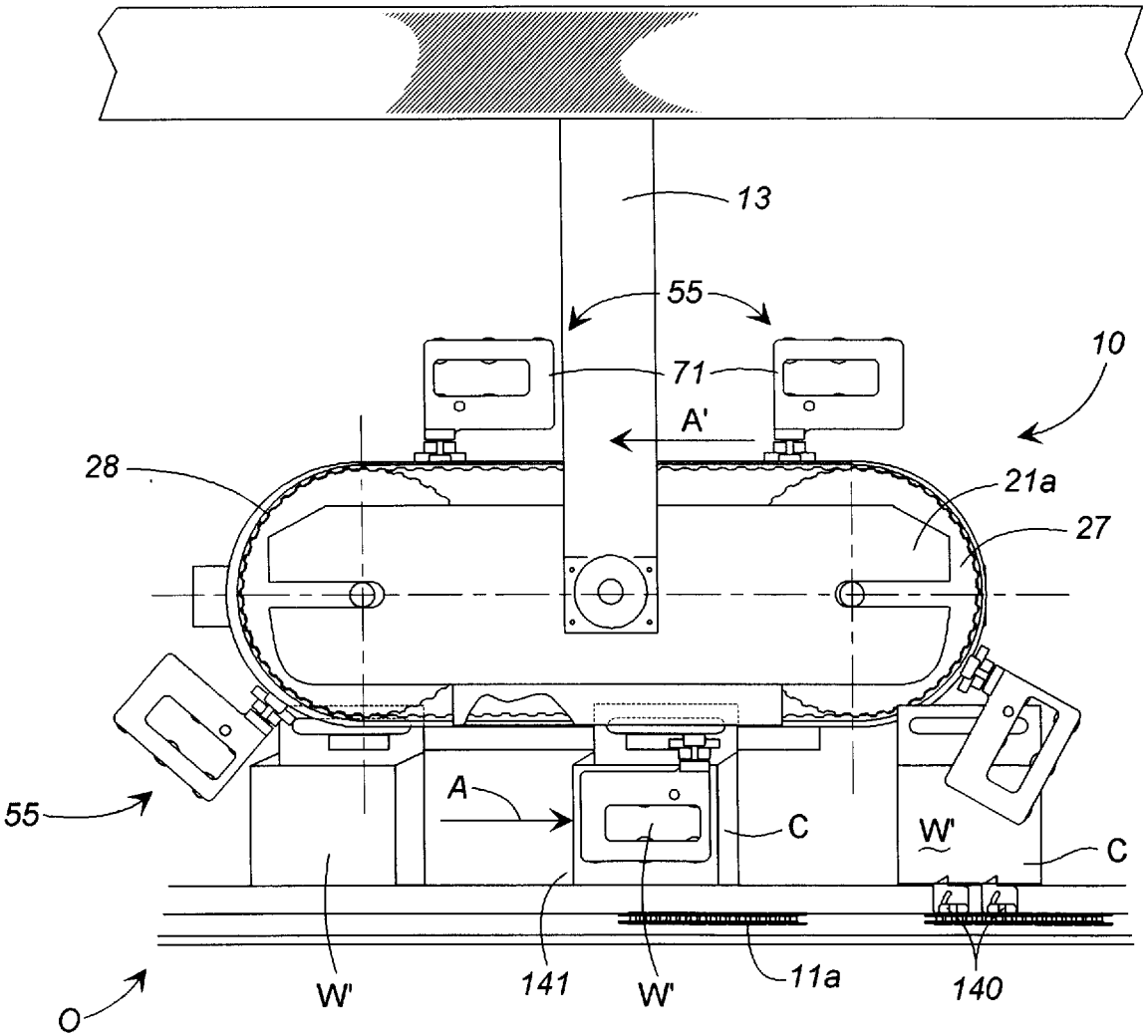
FIG. 4 is a side elevational view of the embodiment of FIG. 1.

An outlet port 78 is formed in the outer or exterior side wall 74 of each vacuum plate and connects the interior channels (not shown) of each vacuum plate with a vacuum source or supply. A vacuum hose 79 or conduit is attached to the outlet port 78. The vacuum hose 79 for vacuum plate 71 generally connects to the carriage and second end 58 of the slide bar 56 at aport 81. Port 81 (FIGS. 5, 6) generally communicates with the hollow chamber (not shown) in slide bar 56 and to port 81*a* to connect to the main vacuum delivery system through hose 79*a*. The vacuum hose 79 for vacuum plate 70 connects directly to a main vacuum delivery system, which will be described in further detail. As a vacuum is drawn through the hoses 79 and 79*a*, the vacuum is also drawn through the hollow inner chambers of the slide bars 56 and through the inlet ports and thus through the vacuum cups 77 of the vacuum plates 70 and 71 as the vacuum plates are carried into engagement with the side walls of a carton as illustrated in FIGS. 4 and 5. In addition, a separate vacuum tube or conduit can be mounted along each slide bar for supplying a vacuum in place of the hollow inner chamber of each slide bar.

Cam followers or rollers 85 and 86 (FIGS. 1, 3, 6 and 8) are mounted to the second or outer side edges 67 of each support plate 63 and 64 of each carton engaging assembly 55. The cam rollers 85 and 86 engage and roll along first or outer cam tracks 87 and 88 (FIG. 8), respectively. As shown in FIGS. 1 and 3, each of the cam tracks 87 and 88 extends about a substantially elliptical path through the opening assembly 10, for controlling the movement of the support plates 63 and 64 and the vacuum plates 70 and 71. Each of the first cam tracks 87 and 88 generally includes a base 91 (FIG. 6) and a pair of upstanding walls 92 and 93 which define an open ended channel 94 along which the cam rollers 85 and 86 roll, to cause the movement of the vacuum plates along their slide bars toward and away from each other in the direction of arrows 62 and 62' (FIG. 6).

As FIG. 8 illustrates, the lower portion of cam track 87 extends substantially parallel to the path of travel indicated by arrow A, and includes a first inwardly extending curve or entry portion 96 along which cam roller 85 is guided to cause the vacuum plate 70 to be moved slightly inwardly into its engaging position with respect to the side wall of a carton C. The cam track 87 further includes an elongated run portion 97 that extends substantially parallel to the path of travel of the cartons, and a second or outwardly extending curve or disengaging portion 98 along which the cam roller 85 is moved to cause the vacuum plate 70 to be moved away from engagement with the carton side wall once the carton has been opened (FIG. 8).

Similarly, cam track 88 (FIGS. 7 and 8) includes an initial or first inwardly extending curve or entry portion 99 along which cam roller 86 (FIG. 8) is moved, to cause support plate 64 and vacuum plate 71 to be moved inwardly to its engaging position with respect to the side wall of the carton opposite vacuum plate 70. As the carton is initially engaged by the opposing vacuum plates 70 and 71, cam roller 86 moves along a first straight or dwell section 101 (FIGS. 7 and 8) to enable the vacuum to be drawn through the vacuum plates, and thereafter engages and moves along an elongated, outwardly angled section 102, which causes vacuum plate 71 (FIG. 8) to be moved outwardly and away from vacuum plate 70 into an opening position. Since plate 70 has engaged a carton side wall by vacuum, this movement pulls its associated carton side wall, so as to cause the carton side walls to be separated and the carton to be opened. Cam track 88 further includes a second, outwardly extending or disengaging portion 103 along which cam roller 86 is moved, to cause vacuum plate 71 to be moved away from its associated carton side wall.

As shown in FIGS. 1 and 6, a pair of second cam tracks 110 and 111 are positioned on opposite sides of the opening assembly adjacent the head and tail sprockets and drive belts 45 and 46. Each of the second cam tracks extends in an elliptical path about the opening assembly 10, and has a substantially C shaped configuration. Cam tracks 110 and 111 include a pair of upper and lower walls 112 and 113, respectively, and a rear wall 114 so as to define a C-shaped, open ended channel 116. Cam rollers 117 (FIG. 6) are attached to the carriages 59 for each of the carton engaging assemblies 55, and engage and roll along the upper and lower walls 112 and 113 of the second cam tracks 110 and 111. The cam rollers 117 support the ends of the slide bars and the support plates 63 and 64 on the cam tracks 110 and 111. The drive belts 45 and 46 are not required to support any of the load of the carton engaging assemblies, but rather serve as a mechanism for driving or pulling the carton engaging assemblies about their elliptical path into engagement with the cartons to insure smooth engagement of the carton engaging assemblies with each of the cartons.

As shown in FIG. 3, a main vacuum supply 120 is mounted on the machine side M of the opening assembly 10, and includes a plenum or vacuum valve 121 that is rotatably mounted on sleeve 18. Vacuum supply 120 is rotated in timed relation with the movement of the carton engaging assemblies 55 about the opening assembly 10. The vacuum valve 121 is a substantially circular disk having a series of inlet ports 122 and radial grooves (not shown) to control the vacuum and atmosphere supplied to the carton engaging assemblies 55. The vacuum valve does not rotate and is held stationary to frame member 13. The vacuum valve 121 includes a rotating vacuum distribution plate 121*a* having an outer surface 123, and connects to a vacuum supply and to each of the opening assemblies 55. A series of outlet ports 124 also are formed on the outer facing surface 123 of the vacuum distribution plate 121*a*, and are connected by vacuum hoses 79 and 79*a* both to the vacuum plates 70 and to the slide bars 56 for each carton engaging assembly 55, as shown in FIGS. 3 and 6, to supply a vacuum force through the vacuum plates 70 and 71. Each vacuum plate 70 is connected directly to the vacuum supply (FIG. 6), while the vacuum applied by vacuum plates 71 is supplied through the hollow inner chamber (not shown) of each slide bar.

The vacuum distribution plate 121*a* is driven in timed relation with the movement of the carton engaging assemblies about the opening assembly by a drive system generally indicated at 131 (FIG. 3). The drive system for the main vacuum supply includes a drive gear 132, which is a sprocket having a series of radially projecting teeth 133. Sprocket 132 is mounted to the first end 24 of the head shaft 22 so as to rotate with the rotation of the head shaft by the main drive mechanism 14. A drive chain 134 engages drive sprocket 132 and toothed sprocket 136 mounted to the vacuum distribution plate 121*a*, to cause the driving or rotation of the vacuum distribution plate 121*a* as the drive sprocket 132 is rotated with the rotation of the head shaft. An idler sprocket 137 is positioned adjacent the drive sprocket and engages the drive chain 134 to prevent slack from forming in the drive chain. Sprocket 137 ensures smooth operation of the drive chain and smooth the rotation of the vacuum distribution plate 121*a* in timed relation with the rotation of the carton engaging assemblies 55 about the opening assembly.

Operation

In operation, feeder F delivers cartons C to conveyor assembly 11. As is well-known in the art, the movement of feeder F, lugged belt mechanism 12, and conveyor 11 are synchronized so that single cartons are continuously fed through the packaging machine P. FIG. 7 schematically depicts the cartons which have been fed from feeder F to conveyor 11. In FIG. 7, conveyor section 11*b* having spaced pairs of lugs 140 engage a carton bottom flap 141. Carton C is moved towards opening assembly 10 along conveyor section 11*b*. As is well-known in the art, cams or plow assemblies (not shown) orient carton C so that handle extends upwardly in a vertical position as carton C enters opening assembly 10.

FIG. 8 schematically shows the stages of sequential operation of opening assembly 10 on five separate cartons C. A properly oriented carton C is shown in position I entering the opening assembly 10. At this position, the vacuum cups 77 of opposed vacuum plates 70 and 71 of each of the carton engaging assemblies 55 have not yet come in contact with the side walls of carton C. From position I shown in FIG. 8, each carton engaging assembly 55, is driven by the main drive mechanism 14 around head and tail sprockets 27 and 28 (FIG. 1), respectively, so that their associated cam followers 85 and 86 are received in the first curved or entry portions 96 and 99 of cam tracks 87 and 88. Cam track portions 96 and 99 (FIG. 8) of cam tracks 87 and 88 respectively, are mirror images of one another, and direct their associated carton engaging assemblies inwardly toward carton C so that the vacuum cups 77 of the vacuum plates of each assembly are compressed with sufficient force to seal the vacuum plates against opposite side walls W and W' of a fully collapsed carton or basket.

FIG. 8 also depicts the carton engaging assemblies 55 in position II. In this position, the opposed vacuum plates 70 and 71 of the carton engaging assemblies are passed through the initial inwardly curved portion 96 of cam track 87 and the first curve portion 99 of cam track 88 and along the straight run portions 97 and 101 of the cam tracks as the vacuum plates of the carton engaging assemblies 55 engage and apply a suction or vacuum to the carton side walls W and W'. This movement insures proper contact between all vacuum cups 77 and the carton side walls, and reduces misalignment and vacuum cup wear possible when the cups strike the carton side walls at an angle less than 90°.

The vacuum cups 77 associated with each vacuum plate of each carton opening assembly 55 are arranged depending upon the size, type and other characteristics of the carton or basket to be opened. Not only size, but other physical characteristics such as cut-outs or windows must be taken into account when designing the vacuum plates and arrangement of vacuum cups 77. Also, the vacuum cups of opposed vacuum plates preferably are not placed in a position that would permit engagement between two opposed vacuum cups. Such engagement could cause damage to the opening assemblies under certain conditions.

Cam track 87 further includes an elongated straight run portion 97 which is substantially parallel to longitudinal path A of opening assembly 10, which is the same as the longitudinal path of conveyor 11. During the longitudinal travel of each carton opening assembly 55 along cam track portion 97, the cam roller 85 for vacuum plate 70 of each carton opening assembly 55 traveling along cam track 87 does not reciprocate substantially inwardly or outwardly, but generally holds its position along the path of travel designated by arrow A, while the carton side wall W adjacent to cam roller 85 is held against the vacuum plate 70 by the vacuum applied therethrough.

In position III, as vacuum plate 70 associated with cam roller 85 moves along a path of travel parallel to straight run 97, vacuum plate 71 associated with cam 86 is retracted outwardly, away from the longitudinal path L of opening assembly 10, by the action of the cam follower 86 moving along outwardly angled section 102 of cam track 88 and away from the longitudinal path of the cartons. As a result, since the vacuum cups 77 of vacuum plate 71 associated with cam 86 are fixed by vacuum against the side wall W' of carton C, the outward movement of the vacuum plate 71 along the slide bar, as shown at position III, begins to pull the carton side wall outwardly, opening the carton C. This outward movement of vacuum plate 71 continues until carton C is fully opened, as shown in position IV. As a result, the carton C is fully opened while moving at machine speed through opening assembly 10 of packaging machine P (FIG. 2). Thus, the action of assembly 10 tracks the movement of carton C by conveyor 11 as the opening sequence is accomplished.

At this fully opened position, the conveyor section 11*a* (FIG. 7), engages flap 145 of carton C with lugs 146, and the force resulting by the vacuum applied to each opposing carton opening assembly is simultaneously released, so that control of the carton movement continuing through packaging machine P (FIG. 2) is assembled by conveyor 11. The action of lugs 140 and 146 (FIG. 7) on the carton flaps 141 and 145 holds the carton in a fully opened position until the carton is delivered to the next workstation of packaging machine, which transfers the carton to a mechanism that lowers the carton over a pre-formed bottle group. Optionally, opening assembly 10 could open the carton only to a partially opened condition prior to hand off to the conveyor. This could be accomplished simply by designing cam track 88 (FIG. 8) so that the vacuum plates 71 of each carton engaging assembly do not retract to an extent so as to fully open the carton. Obviously, the conveyor section 11*a* (FIG. 7) would be adjusted to accommodate a partially opened carton in this instance.

FIG. 8 illustrates that the carton side wall W closest to the maintenance side M of assembly 10 generally remains fixed, that is, the carton side wall W does not move inwardly or outwardly as the carton moves downstream through assembly 10 in the embodiment described above. The carton side wall W' adjacent the operator side of assembly 10, however, is not fixed, but is moved outwardly a distance approximately equal to two bottle diameters. Therefore the movement of cam follower 86 from position II to position IV along cam track 88 also is through a distance of approximately two bottle diameters. It will also be understood that cam track 87 also could be modified so that both vacuum plates, and thus both side walls W and W', of each carton are moved outwardly to separate the walls and open the cartons.

After opening assembly 10 has accomplished the hand-off of a fully opened carton to conveyor 11 at position IV, each opposing vacuum plate 70, 71 of each carton engaging assembly is moved outwardly with the movement of cam followers 85 and 86 along outwardly curved portions 98 and 103 of cam tracks 87 and 88, respectively, to cause the vacuum plates to be moved away from the respective carton side walls W and W' to prevent vacuum cup wear by friction of the vacuum cups on the carton side walls as the vacuum cups are moved upwardly and around the head sprockets.

The present invention also can be designed to accommodate numerous machine pitches and bottle diameters for product groups which utilize different size cartons, by making the head and tail sprockets either larger or smaller. The embodiment chosen to illustrate the present invention is designed for 5 carton engaging assemblies each on a 15 inch pitch or 6 carton engaging assemblies each on a 12½ inch pitch driven by 75 inch belts. It will be understood, however, that for different pitch packaging machines, more or less carton engaging assemblies can be utilized along shorter or longer opening runs. If cartons for bottles of a different diameter are processed through the opening assembly, the shorter carton conveyor 11*a* also may need to be adjusted inwardly or outwardly and/or change part cam 102 used to accommodate the different bottle diameter. Also, the present invention is not limited to two pairs of head and tail sprockets driving the carton engaging assemblies. A different number of such sprockets could be used.

It will be obvious to those skilled in the art that many variations may be made in the above embodiments here chosen for the purpose of illustrating the present invention, and full result may be had to the doctrine of equivalents without departing from the spirit and scope of the present invention, as defined by the appended claims.

What is claimed is:

1. A carton opening assembly for opening a carton having opposed side walls from a collapsed state to an open state as the carton moves along a path of travel at a carton velocity in a downstream direction, said carton opening assembly comprising:

a drive assembly including a series of spaced sprockets positioned along opposite sides of the path of travel, and drive belts extending about and operatively connecting said sprockets;

a series of carton engaging assemblies mounted in spaced series about said drive belts so as to be moved along the path of travel by said drive belts, each carton engaging assembly including a pair of vacuum plates movably mounted along a slide bar, each having a series of vacuum ports formed in an interior side wall thereof, and a cam connected to each vacuum plate;

a first cam track positioned adjacent one side of said drive assembly and engaged by a cam of each carton engaging assembly for guiding said cam transversely across the path of travel as said carton engaging assemblies are moved along the path of travel at the carton velocity, thereby eliminating relative movement in the path of travel between the carton and the carton engaging assembly, to cause said vacuum plates to be moved into engagement with the side walls of the cartons and to an opening position to open the carton; and a second cam track extending substantially parallel to the path of travel and engaged by a cam mounted to each slide bar of each carton assembly for guiding each carton assembly about the path of travel.

2. The carton opening assembly of claim 1 and wherein said carton engaging assemblies each further include pairs of support plates slidably mounted on said slide bar and each having a first end along which a vacuum plate is mounted and a second end to which a cam is mounted.

3. The carton opening assembly of claim 1 and further including clamp blocks mounted on said drive belts and a plurality of carriages pivotally mounted to said clamp blocks for mounting said slide bars to said drive belts.

4. The carton opening assembly of claim 1 and wherein said drive belts each comprise V-belts having a web and a substantially V-shaped projection positioned approximately along the center of said web.

5. The carton opening assembly of claim 4 and wherein said sprockets include channels formed thereabout for receiving said V-shaped projections of said drive belts as said drive belts move about said sprockets.

6. A carton opening assembly for opening a carton having opposed side walls from a collapsed state to an open state as the carton moves along a path of travel at a carton velocity, said carton opening assembly comprising:

a drive assembly including a series of spaced sprockets positioned along opposite sides of the path of travel, drive belts extending about and operatively connecting said sprockets, a drive mechanism, a drive shaft driven by said drive mechanism, a drive gear mounted to said drive shaft and an idler gear engaged by said drive gear and mounted on a head shaft on which a pair of said sprockets are mounted for moving said drive belts about the path of travel;

a series of carton engaging assemblies mounted in spaced series about said drive belts so as to be moved along the path of travel by said drive belts, each carton engaging assembly including a pair of vacuum plates movably mounted along a slide bar, each having a series of vacuum ports formed in an interior side wall thereof, and a cam connected to each vacuum plate; and a first cam track positioned adjacent one side of said drive assembly and engaged by a cam of each carton engaging assembly for guiding said cam across the path of travel as said carton engaging assemblies are moved along the path of travel at the carton velocity, to cause said vacuum plates to be moved into engagement with the side walls of the cartons and to an opening position to open the carton.

7. An opening assembly for automatically opening cartons having opposed side walls moving downstream along a path of travel at a carton velocity in a collapsed state, the opening assembly comprising:

a drive assembly including spaced pairs of head and tail sprockets mounted on head and tail shafts, respectively, and drive belts extending about said head and tail sprockets;

carton engaging assemblies mounted on and moved about the path of travel by said drive belts;

said carton engaging assemblies each including opposed vacuum plates mounted along a slide bar mounted to said drive belts so as to be movable from an engaging position to a spaced opening position and each having a series of vacuum ports formed therein for engaging and applying a vacuum to the side walls of a carton, and at least one carriage mounted on and carried by said slide bar for supporting said vacuum plates; and a first cam track positioned adjacent the path of travel and adapted to engage a cam of each carton engaging assembly as said carton engaging assemblies are moved along the path of travel to cause said vacuum plates to be moved transversely between their engaging and opening positions to open the cartons, wherein said carton engaging assemblies move downstream at the carton velocity prior to carton engagement, thereby eliminating relative movement in the path of travel between the cartons and said carton engaging assemblies.

8. The opening assembly of claim 7 and further including a second cam track that is positioned adjacent and extends substantially parallel to the path of travel of said carton engaging assemblies and is engaged by a second cam of each carton engaging assembly for supporting and guiding said carton engaging assemblies as they move along their path of travel.

9. The opening assembly of claim 7 and wherein said carton engaging assemblies further include clamp blocks mounted on said drive belts and carriages pivotally mounted to said clamp blocks for mounting said slide bars to said drive belts.

10. The opening assembly of claim 7 and wherein said drive assembly further includes a drive mechanism, a drive shaft driven by said drive mechanism, a drive gear mounted to said drive shaft and an idler gear engaged by said drive gear and mounted on a head shaft on which a pair of said sprockets are mounted for moving said drive belt about the path of travel.

11. The opening assembly of claim 7 and further including a vacuum system mounted adjacent the path of travel of said carton engaging assembles and a series of vacuum lines extending from said vacuum system to each of said carton engaging assemblies.

12. An opening assembly for automatically opening cartons having opposed side walls moving along a path of travel at a carton velocity in a collapsed state, the opening assembly comprising:

a drive assembly including spaced pairs of head and tail sprockets mounted on head and tail shafts, respectively, and drive belts extending about said head and tail sprockets;

carton engaging assemblies mounted on and moved about the path of travel by said drive belts;

said carton engaging assemblies each including opposed vacuum plates mounted along a slide bar so as to be movable from an engaging position to a spaced opening position an each having a series of vacuum ports formed therein for engaging and applying a vacuum to the side walls of a carton, and a pair of support plates slideably mounted on said slide bar and each having a first end along which a vacuum plate is mounted and a second end at which a cam is mounted; and a first cam track positioned adjacent the path of travel and adapted to engage a cam of each carton engaging assembly as said carton engaging assemblies are moved along the path of travel to cause said vacuum plates to be moved transversely between their engaging and opening positions to open the cartons, wherein said carton engaging assemblies move downstream at the carton velocity prior to carton engagement.

* * * * *